US005726525A

United States Patent [19]

Friederichs

[11] Patent Number: 5,726,525

[45] Date of Patent: Mar. 10, 1998

[54] ELECTRIC REFLECTOR LAMP

[75] Inventor: Winand H. A. M. Friederichs, Eindhoven, Netherlands

[73] Assignee: U.S. Philips Corporation, New York, N.Y.

[21] Appl. No.: 615,758

[22] Filed: Mar. 13, 1996

[30] Foreign Application Priority Data

Apr. 3, 1995 [EP] European Pat. Off. ..... 95200842

[51] Int. Cl.[6] ..... H01J 5/12; H01K 1/46

[52] U.S. Cl. ..... 313/318.07; 313/318.11; 313/113; 313/33; 362/377

[58] Field of Search ..... 313/318.01, 318.07, 313/318.11, 113, 25, 33, 43; 362/377; 439/612, 613, 615

[56] References Cited

U.S. PATENT DOCUMENTS

| | | | |
|---|---|---|---|
| 4,829,210 | 5/1989 | Benson et al. | 313/318.11 |
| 5,199,787 | 4/1993 | King et al. | 362/310 |
| 5,281,889 | 1/1994 | Fields et al. | 313/113 |
| 5,367,219 | 11/1994 | Friederichs | 313/113 |
| 5,466,981 | 11/1995 | Fields et al. | 313/318.11 |
| 5,528,106 | 6/1996 | Janset et al. | 313/623 |
| 5,556,191 | 9/1996 | Maassen | 362/256 |
| 5,568,967 | 10/1996 | Sikkens et al. | 362/328 |
| 5,646,473 | 7/1997 | Eggink et al. | 313/113 |

OTHER PUBLICATIONS

PHN 15,231, U.S. Ser. No. 08/517,154, filed Aug. 21, 1995.
PHN 15,215, U.S. Ser. No. 08/607,960, filed Mar. 13, 1996.

*Primary Examiner*—Michael Horabik
*Assistant Examiner*—Michael Day
*Attorney, Agent, or Firm*—Walter M. Egbert, III

[57] ABSTRACT

An electric reflector lamp is disclosed having a reflecting surface and a neck. A light source having a glass lamp vessel with a pinch seal is accommodated in the reflector body, the pinch seal being located in the neck. A mounting plate is present on the pinch seal. The plate is the bottom of a bush which extends axially along the lamp vessel towards the reflecting surface and which has a transversely extending rim which closes the neck.

2 Claims, 2 Drawing Sheets

ELECTRIC REFLECTOR LAMP

BACKGROUND OF THE INVENTION

The invention relates to an electric reflector lamp comprising:

a concave moulded reflector body with an optical axis, a concave reflecting surface, and a neck which has a free-end potion with a bottom wall;

a lamp cap provided with contacts and fastened to the neck;

a light source provided with a glass lamp vessel with a pinch seal arranged in the reflector body, with the pinch seal in the neck, current conductors extending through the pinch seal to an electric element accommodated in the lamp vessel;

a mounting plate with an opening through which the pinch seal of the lamp vessel is passed, which mounting plate is positioned in the neck and bears on the reflector body in the direction of the axis, the current conductors extending tautly tensioned through the bottom wall of the reflector body and being connected to the contacts of the lamp cap.

Such an electric reflector lamp is known from U.S. Pat. No. 5,367,219.

The lamp vessel of the light source extends comparatively far into the neck, so that not only the seal of the lamp vessel is present in the neck, unlike the situation in the reflector lamp of U.S. Pat. No. 5,528,106. Comparatively much heat is dissipated also in the neck as a result. Depending on the power consumed by the lamp and its luminous efficacy, but also dependent on the volume of the reflector body, there is a risk of the lamp cap assuming a temperature which exceeds normally accepted standards.

A similar reflector lamp is described in allowed U.S. application Ser. No. 08/517,154, filed Aug. 21, 1995 now U.S. Pat. No. 5,667,297, where the lamp vessel also projects far into the neck and where the reflecting surface comprises a body of revolution of a branch of a parabola which has been tilted relative to the optical axis, plane axial lanes being superimposed on the surface.

U.S. Pat. No. 5,556,191 describes a reflector lamp in which the reflecting surface is a paraboloid near the neck and a body of revolution of a parabola branch tilted relative to the optical axis remote from the neck, the focal points of these portions lying mutually separate on the axis.

In the reflector lamp according to U.S. Pat. No. 5,646,473, a ceramic body is present around the seal in the neck. This reduces the temperature of the seal, but owing to the increased heat dissipation of this seal the temperature of the lamp cap of this lamp is higher than it would be without said body.

Allowed U.S. application Ser. No. 08/607,960 filed Mar. 13, 1996 describes a reflector lamp in which a plate is present near the lamp cap on the lamp vessel seal, and in which the lamp vessel is secured in the neck with cement. The plate achieves that there is an open passage alongside the cement from the lamp cap to the reflecting surface. The lamp as a result can breathe during operation.

In the reflector lamp of U.S. Pat. No. 5,281,889, the neck is a separate body, and the mounting plate is enclosed between the neck and the reflector body.

A reflector lamp is known from U.S. Pat. No. 5,199,787 wherein the reflector body is closed off with a lens.

SUMMARY OF THE INVENTION

It is an object of the invention to provide an electric reflector lamp of the kind described in the opening paragraph which is of a simple construction with which the risk of a comparatively high lamp cap temperature is counteracted.

According to the invention, this object is achieved in that the mounting plate is the bottom of a bush which extends along the lamp vessel to the reflecting surface and has a transversely projecting rim there which closes off the neck.

It was found that the bush-type mounting member effectively counteracts a comparatively high temperature of the lamp cap. The mounting member hampers or prevents convection flows from the reflecting portion of the reflector body and also intercepts radiation.

The mounting member itself may bear with its bottom on the reflector body in axial direction, for example on projections present in the neck of said body. This, however, requires a complicated mould for manufacturing said body. It is favorable when the mounting plate, the bottom of the mounting member, bears with the projecting rim of the bush on the reflector body adjacent the reflecting surface. The mould will then be simpler and the dimensional independence of the mounting member, will be greater. It is prevented in that case that the plate itself bears on projections or on a rim in the neck, and that the rim provides an imperfect closure of the neck owing to a too great length of the bush.

It is in addition favorable for the stability of the assembly of the lamp vessel in the reflector body when the bush bears with its projecting rim on the reflector body at a comparatively great axial distance from the place where the current conductors issue from the pinch seal.

In a favorable embodiment, mutually opposed tongues are present at the mounting plate which press against mutually opposed sides of the pinch seal. It is particularly favorable for the stability of the light source when such tongues are present at the mounting plate for each of the sides of the pinch seal.

The measure according to the invention is so effective that the lamp can be given comparatively small dimensions, and accordingly a comparatively small volume which, without the measure according to the invention, would involve a comparatively high risk of causing a comparatively high lamp cap temperature. Thus the reflector body may be given a greatest transverse dimension of no more than approximately 50 mm, so that the neck can be so narrow that only a lamp cap of approximately 14 mm diameter, for example an E14 or a B15d lamp cap, can be mounted without special provisions.

The current conductors may be readily held tensioned between the lamp vessel and the bottom wall, for example, in that they are enclosed and secured, clamped-in or welded, in bushes which press against the bottom wall at the side thereof facing the lamp cap, or in that they are welded or soldered in, for example, tubular rivets which are fixed in the bottom wall.

The light source may be an incandescent body, for example in an inert gas comprising a halogen, or a pair of electrodes in an ionizable gas, for example accommodated in an inner envelope made of, for example, quartz glass or ceramic material such as, for example, polycrystalline alumina.

It will be evident that it is of little importance for the essence of the invention what shape the reflecting surface has: ellipsoidical, paraboloidical, or of a different concave shape, and whether superimposed lanes or facets are present thereon, for example as described in U.S. Pat. No. 5,568,967.

The reflector body may be closed off with a plate or lens, so that the reflector lamp is suitable for use in an open luminaire.

The reflector body may be metallized in order to make the surface reflecting, for example with aluminum, silver, and/or gold, or may be coated with a light-reflecting dichroic filter.

BRIEF DESCRIPTION OF THE DRAWINGS

An embodiment of the electric reflector lamp according to the invention is shown in the drawing, in which.

DESCRIPTION OF THE PREFERRED EMBODIMENTS

Figure 1:
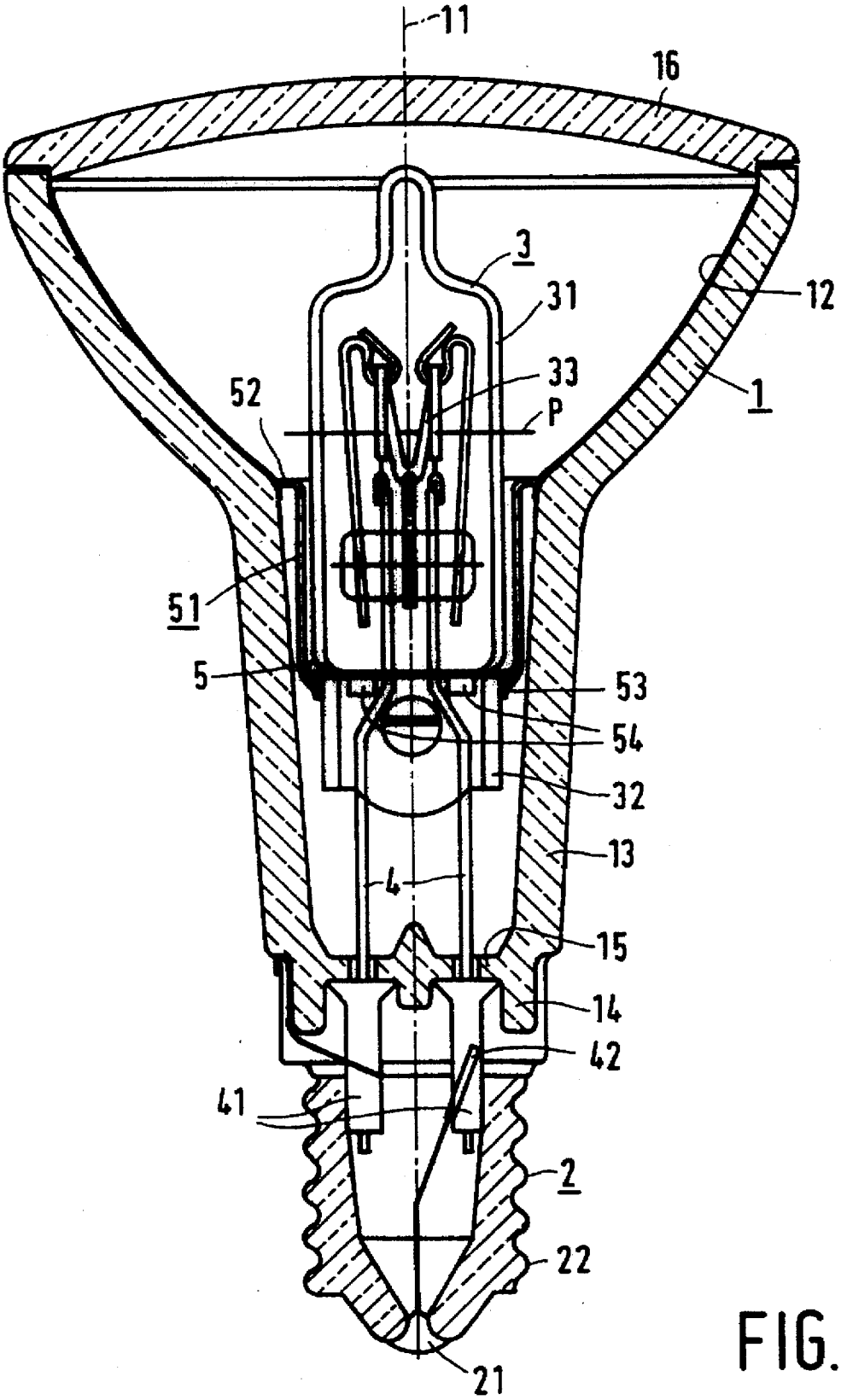
FIG. 1 shows the lamp in axial sectional view.
Figure 2:
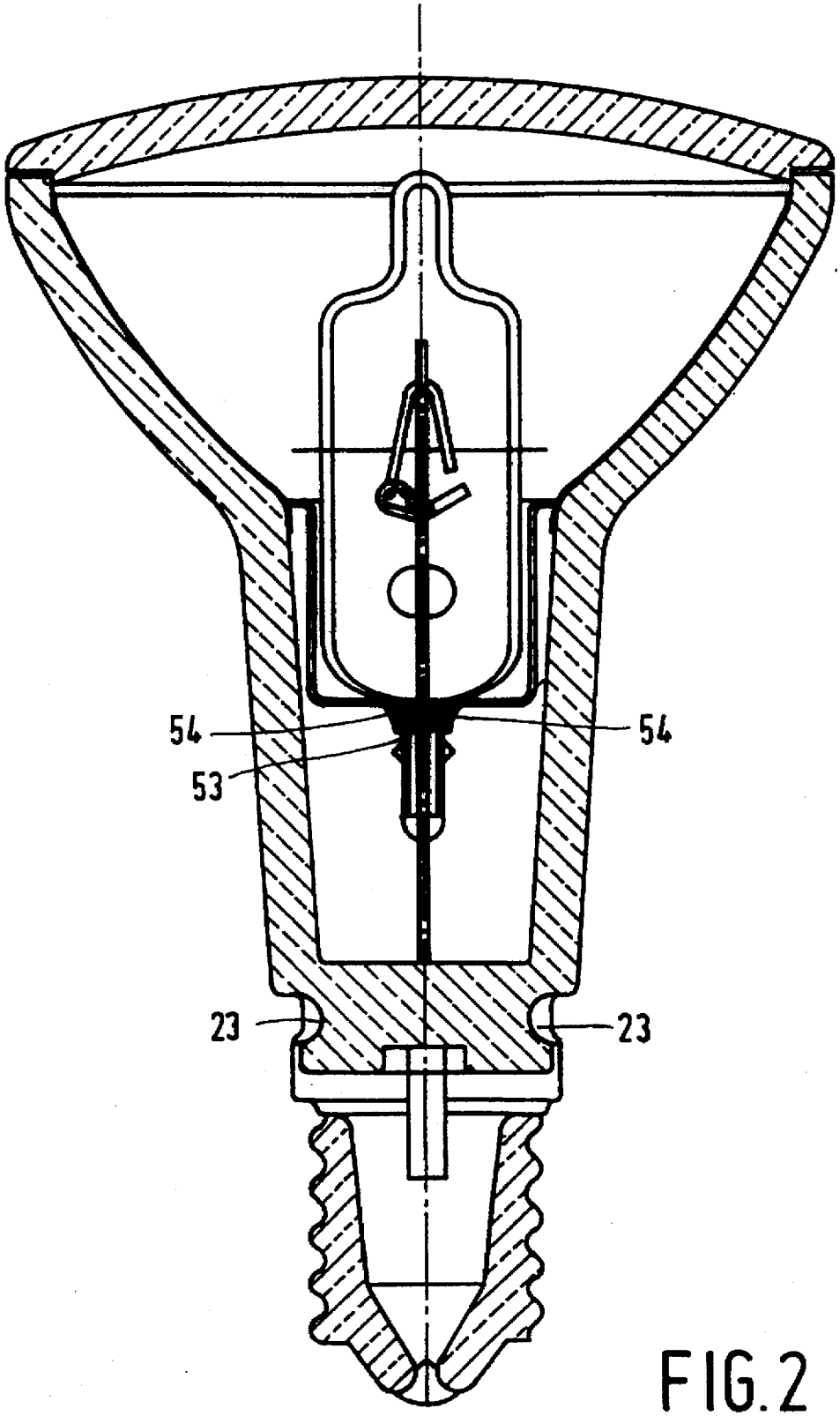
FIG. 2 shows the lamp of FIG. 1 rotated through 90° about its axis.

The electric reflector lamp of FIGS. 1 and 2 has a concave moulded reflector body 1, made of moulded glass in the Figures, with an optical axis 11, a concave reflecting surface 12, and a neck 13 which has a free-end potion 14 with a bottom wall 15. The reflecting surface is paraboloidically curved. Its focal plane is referenced P. A lamp cap 2 with contacts 21, 22 is fastened to the neck 13. A light source 3 provided with a glass lamp vessel 31, made of hard glass in the Figures, with a pinch seal 32 is arranged in the reflector body 1, with the pinch seal 32 in the neck 13. Current conductors 4 extend through the pinch seal to an electric element 33 accommodated in the lamp vessel, in the Figures an M-shaped (FIG. 1) incandescent body in a gas comprising a halogen, designed for operation at mains voltage. Furthermore, the lamp has a mounting plate 5 with an opening through which the pinch seal 32 of the lamp vessel 31 is passed. The plate is positioned in the neck 13, approximately halfway its length, and bears on the reflector body 1 in the direction of the axis 11. The current conductors 4 extend tautly tensioned through the bottom wall 15 of the reflector body 1 and are connected to the contacts 21, 22 of the lamp cap 2. Each current conductor is fixed in a metal tube 41 which presses against the bottom wall. A safety fuse 42 forms part of one current conductor.

The mounting plate 5 is the bottom of a bush 51 which extends along the lamp vessel 31 to the reflecting surface 12 and has a transversely projecting rim 52 there which closes off the neck 13.

In the Figures, the mounting plate bears exclusively with its projecting rim 52 on the reflector body 1 near the reflecting surface 12, in the Figures in the location where the reflecting surface merges into the neck. The mounting plate 5 has mutually opposed tongues 54 which press against mutually opposed sides of the pinch seal 32. Mutually opposed tongues 53 are also present, pressing against the other mutually opposed sides of said seal.

The reflector body 1 is closed off with a transparent plate 16. The lamp cap 2 has indentations 23 by means of which it is fixed to the neck 13.

I claim:

1. An electric reflector lamp comprising:

a concave reflector body with an optical axis, a concave reflecting surface, and a neck which has a free-end portion with a bottom wall;

a lamp cap provided with contacts and fastened to the neck;

a light source provided with a glass lamp vessel with a pinch seal arranged in the reflector body, with the pinch seal in the neck, current conductors extending through the pinch seal to an electric element accommodated in the lamp vessel;

a mounting plate with an opening through which the pinch seal of the lamp vessel is passed, which mounting plate is positioned in the neck and bears on the reflector body in the direction of the axis, the current conductors extending tautly tensioned through the bottom wall of the reflector body and being connected to the contacts of the lamp cap, characterized in that: the mounting plate is the bottom of a bush which extends axially along the lamp vessel to the reflecting surface and has a transversely projecting rim there which closes off the neck.

2. An electric reflector lamp as claimed in claim 1, characterized in that the projecting rim bears on the reflector body adjacent the reflecting surface.

* * * * *